US006412643B1

(12) United States Patent
Wysolmierski

(10) Patent No.: US 6,412,643 B1
(45) Date of Patent: Jul. 2, 2002

(54) FERROUS PARTICLE MAGNETIC REMOVAL AND COLLECTION APPARATUS

(76) Inventor: Robert T. Wysolmierski, 60 Rt. 101A, Amherst, NH (US) 03031

( * ) Notice: Subject to any disclaimer, the term of this patent is extended or adjusted under 35 U.S.C. 154(b) by 0 days.

(21) Appl. No.: 09/789,853

(22) Filed: Feb. 21, 2001

(51) Int. Cl.[7] ..... B03C 1/00

(52) U.S. Cl. ..... 209/213; 209/214; 209/216; 209/225; 209/636; 209/904

(58) Field of Search ..... 209/213, 214, 209/216, 217, 219, 225, 220, 227–229, 636, 904; 335/296, 302, 306, 355

(56) References Cited

U.S. PATENT DOCUMENTS

| | | | | | |
|---|---|---|---|---|---|
| 3,952,857 | A | * | 4/1976 | Nazuka | 198/41 |
| 4,318,943 | A | * | 3/1982 | Veenstra | 427/240 |
| 5,170,891 | A | * | 12/1992 | Barrett | 209/223.2 |
| 5,797,498 | A | * | 8/1998 | Kobayashi et al. | 209/636 |

FOREIGN PATENT DOCUMENTS

| | | | |
|---|---|---|---|
| JP | 355032047 | A * | 3/1980 |
| JP | 06351229 | | 12/1994 |
| JP | 408-17625 | A * | 1/1996 |

OTHER PUBLICATIONS

"Hercules Permanent Magnetic Pulleys (Non–Electric)", Homer Magnetics. Bulletin No. PY–260.

"Permanent Magnetics Separators—Magnetic Separation of Ferrous from Non–Ferrous Material", Bunting Magnetics Co.. No. 1100, c. 1979, pp. 1–16.

Eriez Manufacturing Co., "Special Assemblies", pp. 3–5.

* cited by examiner

*Primary Examiner*—Donald P. Walsh
*Assistant Examiner*—Joseph Rodriguez
(74) *Attorney, Agent, or Firm*—Davis & Bujold, P.L.L.C.

(57) ABSTRACT

An apparatus and method for removing ferrite particles from a material flow introduced into the apparatus. The apparatus has a housing supporting a magnetized roller with which the material flow is brought into contact with to extract the ferrite particles. The roller has an outer surface which extracts and captures the entrained ferrite particles along a highly magnetized pathway formed by a spiral extending along and circumventing a portion of the outer surface of the roller. The spiral can be an exposed magnetic pole exerting a radial magnetic force induced from a magnet core in contact with the spiral on entrained ferrous particles in the material flow, thus attracting the particles to the magnetic poles on the pathway. A non ferrous wiper is brought into contact with the roller, which forces the captured ferrite particles to follow the pathway towards an end of the roller surface where the radial magnetic force of the pathway is reduced in order to allow removal of the captured particles from the roller into a collection area.

17 Claims, 6 Drawing Sheets

FERROUS PARTICLE MAGNETIC REMOVAL AND COLLECTION APPARATUS

FIELD OF THE INVENTION

The invention relates generally to a ferrite particle collection apparatus for removing entrained ferrous particles from a material flow. Specifically, the invention relates to a magnetic collection apparatus having a material flow passage including at least a magnetic ferrous particle collector in the form of a rotatable magnetic roll or drum located within the passage. The magnetic roll or drum is caused to rotate in contact with the material flow having entrained ferrous particles.

The material having the entrained ferrous particles is fed into the apparatus and caused to come into contact with the magnetic roll or drum. The material passes over and around the magnetic roll or drum, and the entrained ferrous particles are removed from the material flow by attraction to the magnetized surface of the roll and subsequently wiped or cleaned from the roll into a final collection area.

BACKGROUND OF THE INVENTION

Many commercial processes involve temporary storage, transfer, and handling of bulk material or material flows, both liquid and dry product, during manufacture which subject the bulk material or material flow to equipment having or made from iron or iron compounds. During such commercial processes, metallic articles, pieces of iron, or material containing iron or other ferrous particles may break free from the equipment and be entrained in the material or material flow. Also, metal items or articles may be deposited, dropped or fall into the bulk materials from sources extraneous to the processes e.g. workers tools, jewelry or other personal items,often find their way into such bulk material manufacturing processes.

These articles and particles are undesirable in most all manufacturing situations. Iron particles in food processing are particularly undesirable, both from a health/cleanliness viewpoint and from the potential for damage to processing equipment caused by the iron particles. Numerous methods to remove the iron have therefore been developed, including magnetic deposition. However, magnetic deposition methods in use have drawbacks due to the configuration of the magnets in conjunction with other component parts.

Separator equipment using magnets to remove iron particles by deposition is well known in the art. Examples include magnetic drums, magnetic pulleys, and tube magnets. Magnetic drums in use have a (partial or half round 180 degree) stationary magnet inside a rotating cylinder to separate ferrous from non-ferrous material passed over the drum surface. Expensive strong rare earth magnets are valuable due to the concentration of magnetic flux on the surface and close to the surface. Magnetic drums suffer in efficiency because of the extra air gap between the stationary magnet and the rotating cylinder wall. Rare Earth Magnetic strength is reduced due to the additional air gap, therefore efficiency of particle collection is reduced. Magnetic drums create rotating air currents that often allow a high percentage of non ferrous powdered product to infiltrate the iron collection area. Magnetic drums discharge the ferrous fraction along their entire length adding to this product loss. This limits the magnetic application and or is costly by the loss of product. It is not uncommon to find powdered product loss due to this phenomenon to be 30% or higher.

Magnetic pulleys have a similar drawback. Magnetic pulleys utilize a belt to transfer the bulk material with entrained ferrous particles past a stationary magnet. Due to the distance of the magnetic pulley from the top of the belt where the contamination and product are present, the magnetic strength necessary for particle attraction is reduced in relation to belt thickness.

Self cleaning (easy clean) tube (grate magnets) require a series of non-ferrous wipers to slide ferrous material to dead zones present at one end for release. The collected iron is physically pulled across alternating north south poles against the natural polarity force. (Magnetic separators sometimes use this principal to purify a ferrous iron powder product by causing the iron powder to jump magnetic fields enabling it to release less magnetic particles. Moving ferrous material by traveling along north south poles is more desirable because one is working with natural forces and iron or paramagnetic iron are less likely to be accidently discharged into the product.

Self cleaning tubes (grates) have more parts to wear due to friction, they are more complicated by design due to the number of parts and precision fit wipers on the tube, are difficult to manufacture, have higher maintenance requirements, are not as magnetically strong due to their limited size, and handle less capacity of product due to the grate configuration of tubes typically 1" tubes on 2" centers. The ferrous particles are required to be forced against alternating magnetic fields for removal. This often requires considerable force when rare earth Neodymium-Iron Boron Magnets reaching MGOe 30 to 45 strengths are used. Also, where large volumes of iron are present on a tube, the force required to wipe or pull the iron across the tube becomes impractical.

SUMMARY OF THE INVENTION

To overcome the above drawbacks of existing ferrous particle removal devices, it is therefore an object of the invention to provide a magnetic roll with high magnetic strength, to maximize entrained ferrous particle removal. This is accomplished with the claimed invention having one or more magnets forming or in contact with a specifically defined portion of the roll surface.

It is a further object of the invention to provide for simpler yet more effective removal of the ferrous particles after their attachment to the roll. This is accomplished with the roll surface having a magnetic collection surface portion formed as a contiguous surface, similar to a screw shape, about the surface of the roll. The collection spiral portion can be magnetically induced into a magnetically attractive state by a plurality of magnets in contact with the collection spiral, wherein one or more magnets in direct contact with the collection spiral create exposed magnetic poles of the outer face of the spiral.

Another object of the invention is to capture and collect a substantial amount of ferrous particles or articles on the magnetic poles of the outer surface of a roll having a spiral, and although magnetic poles themselves are not new, in the spiral shape of the claimed invention, they permit a greater opportunity to attract and retain captured ferrous material under an outside influence to along the length of the roll and easily follow the direction of the spiral to a discharge end of the roll for removal and collection.

It is a further object of the invention to permit a more complete removal of the captured ferrous material from a roll, one way is by reducing the magnetic field strength locally at a discharge end of the roll which locally reduces the forces holding the particles on the roll wall and allows the particles or articles to be collected in a collection area.

A yet further object of the invention is to provide a simple mechanical wiping or cleaning system for the roll. This is accomplished in the claimed invention by providing a barrier, wiper or scraper of a non-magnetic material or fluid flow, the wiper having a length closely matching that of the roll. By bringing the barrier, wiper or scraper into contact with a part of the roll surface over the entire length of the roll, and rotating the roll against such an obstruction the captured ferrous material is driven in an auger-like motion towards the discharge end.

According to the invention there is provided an apparatus for removal of entrained ferrous particles from a desired material, through magnetic attraction, comprising an inlet and an outlet defining a material flow way therebetween; a magnetic roller positioned in the material flow way, the magnetic roller having an outer surface defining a radially attractive magnetic field along a portion of the outer surface of the roller.

Also according to the invention there is provided an apparatus for removal of entrained ferrous particles from a desired material, through magnetic attraction, comprising at least one spiral magnetized by inducement each said spiral being formed as a roll assembly comprising at least one magnet positioned in the continuous pitch gap at least one non-ferrous material bonded to an outside surface of the at least one magnet within the pitch gap and a continuous exposed outer surface of the spiral each roll assembly having a central longitudinal axis of rotation each roll assembly rotates about its axis of rotation at a preselected rotation speed and each roll assembly having at least one scraper of a non magnetic material for removal of said particles from each said roll assembly wherein the material containing ferrous particles being passed in close proximity to each said roll assembly, the ferrous particles being magnetically captured by each said roll assembly, the captured particles being subsequently removed from each said roll assembly by said rotation of each said roll assembly against an obstruction, and said captured particles transfer to an end of each said roll by a continuous obstruction contact along the roll assembly.

According to the invention there is also provided a method for removal of entrained ferrous particles from a desired material, through magnetic attraction, comprising the steps of creating a magnetic field along a non-linear portion of an outer surface of a cylindrical roller; positioning the cylindrical roller in a material flow; attracting ferrous particles from the material flow onto the non-linear magnetized portion of the outer surface of the roller; rotating the cylindrical roller relative to a linear obstruction substantially in contact with the outer surface of the roller to force the ferrous particles along the non-linear magnetic field of the outer surface of the cylindrical roller towards an area of reduced magnetic field; and removing the attracted ferrous particles from the outer surface of the roller.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
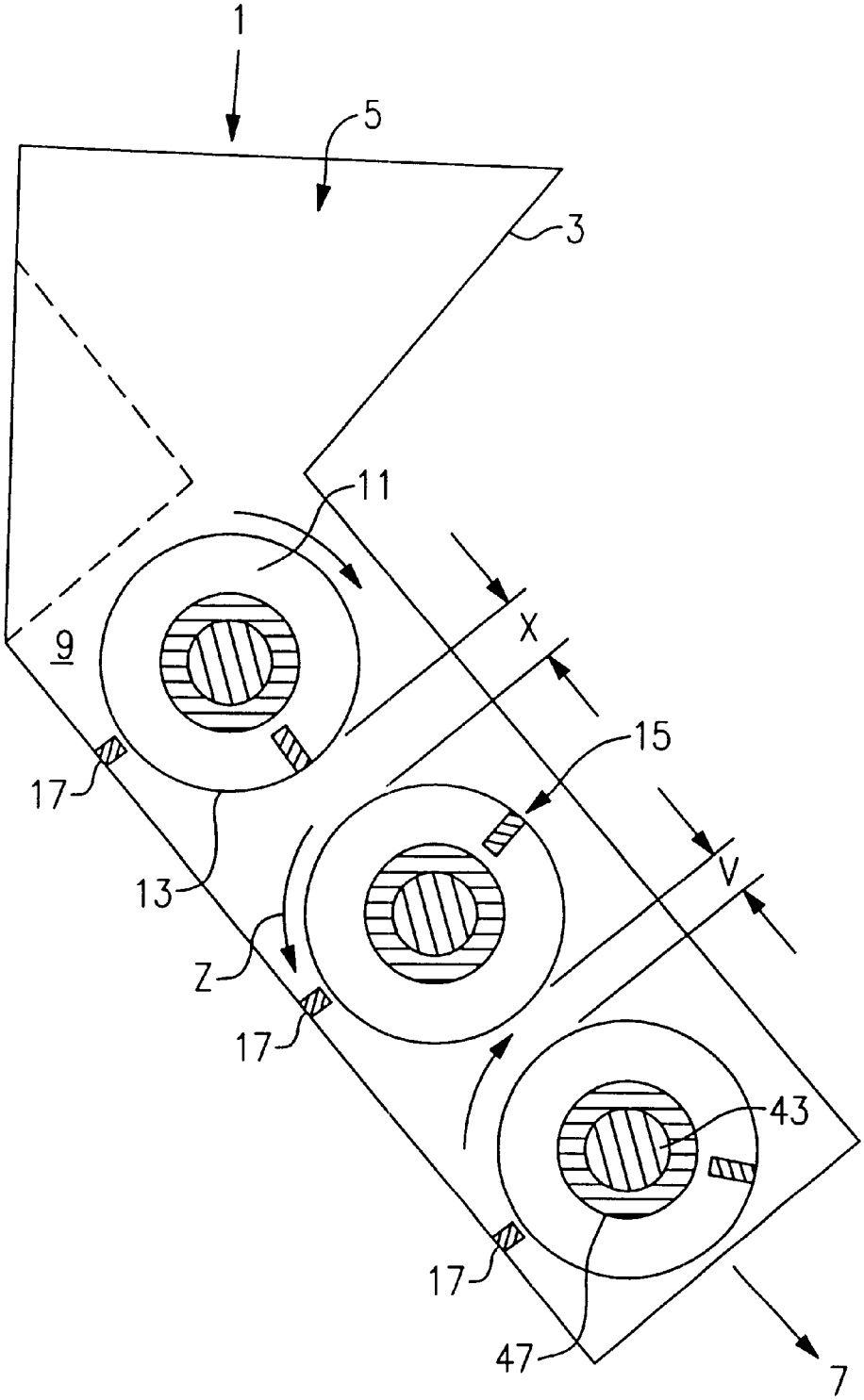
FIG. 1 is a sectional side view of the apparatus showing a typical assembly of rolls in a typical housing.

Referring to FIG. 1, a ferrous metal particle removal apparatus 1 will now be described in general. The elements of the apparatus 1 are contained within a housing 3. The housing 3 is in general provided with an inlet 5 and an outlet 7 defining a material flow passage 9 therebetween. A material, for instance a semi-soluble food product such as ground meat, from which ferrous particles are to be removed is introduced into the apparatus 1 through the inlet 5. The ground meat product flow travels through the material flow passage 9 towards the outlet 7 by gravity feed or by other mechanical means as is known in the art. At a desired location in the passage 9 the ground meat is brought into contact with the magnetic drum or roll assembly 11. The magnetic drums or rolls 11 may be caused to rotate at a desired speed by a dedicated motor (not shown), and are positioned in such a manner in the passage 9 so as to contact sufficient of the material flowing through the passage to remove or extract substantially all of the ferrous particles entrained within the material.

In the typical application, two or more rolls 11 are mounted within housing 3 and spaced to permit suitable clearance for the type of material passing over each assembly. The material containing entrained ferrous particles enters at inlet 5, and exits after extraction of ferrous particles at outlet 7.

Rolls 11 may or may not rotate. After sufficient time or buildup of ferrous particles, wipers 17 are brought, either manually or automatically, into physical contact with each roll 11. Rolls 11, if already rotating, continue their rotation, and if not rotating, are rotated during the period in contact with each wiper 17 to clean each roll 11 of ferrous particles.

In the embodiment shown in FIG. 1, the roll 11 arrangement provides wide roll 11 spacing X on the inlet 5, upstream flow side, and close roll spacing V on the outlet 7, downstream flow side. This type of spacing allows larger particle or piece separation, without damage to the upstream roll 11, and finer particle capture, by narrower passage size using close roll spacing V between the downstream flow side rolls. Also shown in FIG. 1, an example direction of rotation is indicated by arrows Z although it is to be appreciated that the direction of rotation is application dependent. The direction of rotation Z can be the same or vary for each roll 11.

Each of the magnetic collection roll(s) 11, rotatably supported within the passage 9 of the apparatus 1, has a magnetically attractive outer surface material. A portion of the outer surface 13 defines a highly magnetized path or plurality of separate paths 15 towards which the majority of the entrained ferrite particles are attracted. The path(s) 15 concentrate a sufficient magnetic force to overcome the retention bond exerted by the material flow on entrained ferrite particles and collects a majority of the extracted particles along the path 15. The magnetic force exerted by the path 15 on the particles is also strong enough to retain any ferrite particle on the outer surface 13 which is extracted from the material despite the continued rotation of the roll 11 and further subsequent contact with the material flow. A further description of the structure and function of the magnetic collection roll 11 is provided below.

After a desired period of time, or upon a sensing device (not shown) in the apparatus 1 acknowledging an accumulation of a specific amount of ferrite particles on the path 15 of the collection roll 11, the non-magnetic wiper or scraper (wiping device) 17 is brought into contact with the outer surface 13 of the roll 11. The wiper 15 contacts a portion of the circumference of the outer surface 13 of the roll 11 along the length of the roll 11. As the roll rotates relative to the axially stationary wiping device 17, the magnetically retained ferrite particles on the roll surface are brought into contact with the wiper 17 and are influenced into following the magnetic path 15 along the surface 13 of the roll 11. The magnetic path 15, in combination with the wiper 17, guides the collected ferrite particles towards a magnetic path termination point 19, at which point, the ferrite particles accumulate to such an extent that they either drop from the roll into a specific collection area, or may be readily removed by a removal process as is known in the art.

Figure 2:
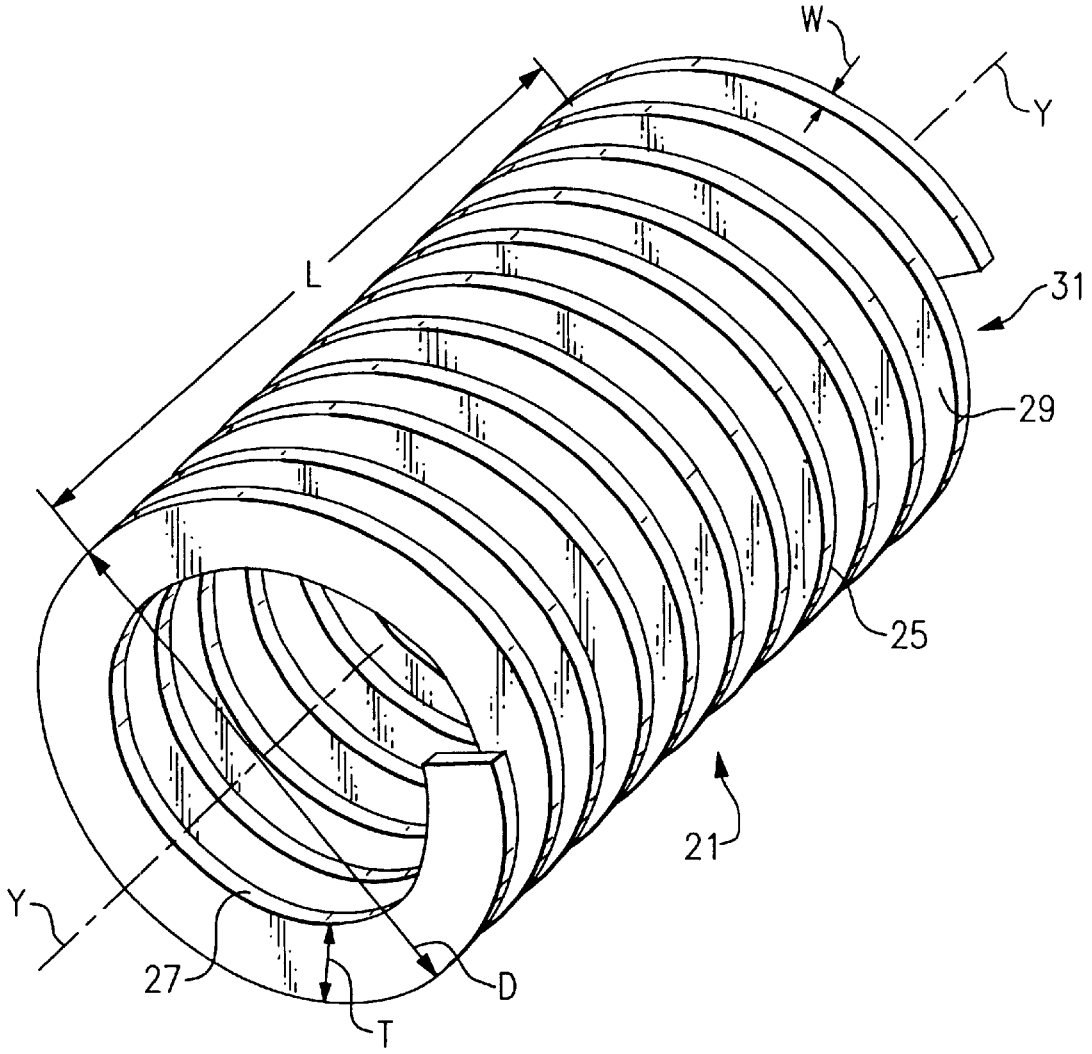
FIG. 2 is a perspective view of a magnetic spiral, prior to formation as a roll assembly, showing both the inherent gaps between the spiral walls, and the depth and thickness of the spiral material.
Figure 3:
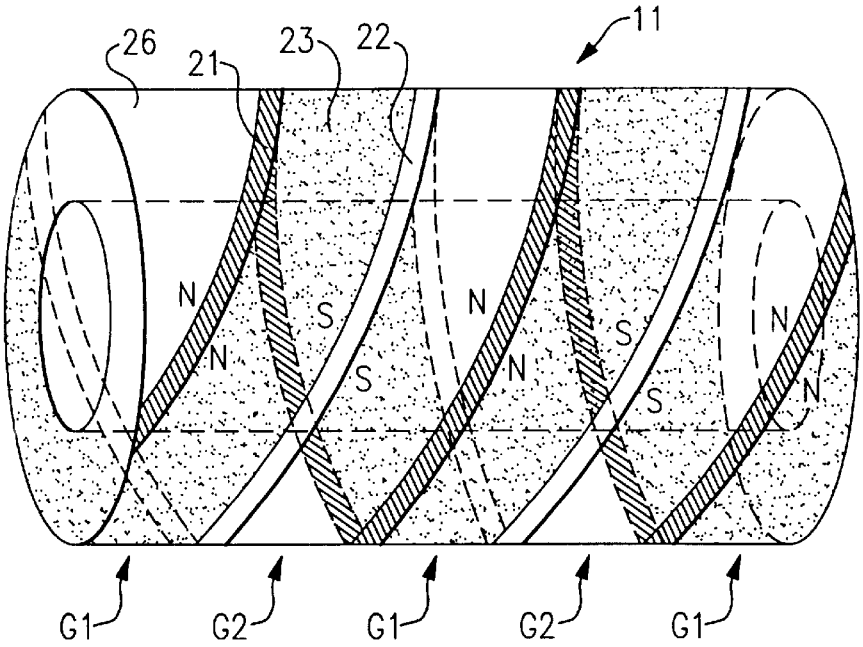
FIG. 3 is a perspective side view of a magnetic roll assembly showing a pair of spirals inter-spaced by magnets.
Figure 4:
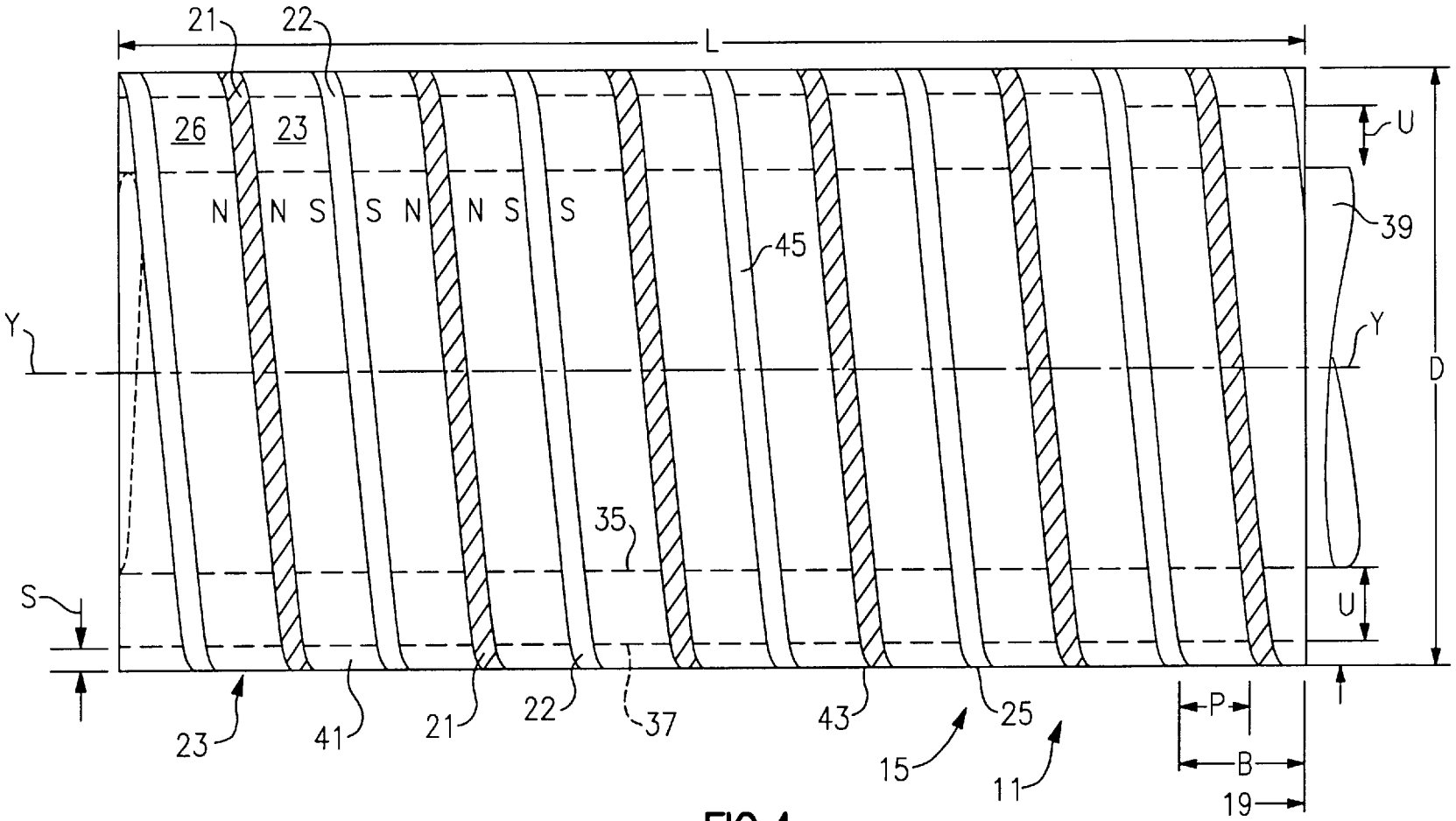
FIG. 4 is a side elevation of a roll assembly showing a spiral inter-spaced by magnets, and supported about an internal spindle support defining an axis Y.

Referring now to FIGS. 2–4, a detailed description of the rotating magnetized collection roll is now provided. The collection roll 11 has on its surface 13 the magnetic path(s) as described above. Each magnetic path 15 is in fact a non-linear magnetic pole, in particular a helical or spiral coil 21 defining a magnetically attractive pole along its length to which the entrained ferrite particles are attracted. The cylindraceous spiral 21 is shown having a diameter D and length L which, as readily apparent to a person of skill in the art, can vary depending upon the size and shape of the roll 11 necessary for a particular process. The spiral 21 also has dimensions of width W and thickness T as shown. These variables can also be changed to suit the desired size of the roll assembly, and the magnetic strength of the path 15 as desired, or to accommodate a commercially available magnetic spiral 21.

The roll 11 is shown mainly as a cylindrical roll 11 throughout the drawings, however, the outer surface 13 of the roll may be formed in any desired geometrical form for instance as a cone, or a frusto conical roller defining a varying outer diameter along the length of the roll 11. As an example, for use with liquids, a preferable form of the invention would be a roll having a large central diameter tapering to smaller diameter ends, in essence two frustums of right circular cones joined at their larger diameters and rotatable about a common axis. Furthermore the outer surface 13 of the roll 11 does not have to be smooth but can be dimpled, rough or varying in a non-planar manner as necessary for a particular process.

Where the outer surface 13 is of such a variable diameter, it is to be appreciated that so also can the spiral 21 have a variable outer diameter D to substantially coincide with the configuration of the outer surface 13.

It should be noted that although only a single spiral 21 is described above, a plurality or more preferably two spirals 21 may be axially and helically aligned, or nested, to provide a number of separate magnetic paths along the surface of the roll 11. For instance in the case of two spirals, to be described further below, one spiral is generally a south pole and the other separate spiral being the north pole of a magnetic field.

The method of manufacturing the magnetic spiral 21 can be by any known and commercially acceptable method. Some examples include; forming a sufficient length of magnetic material of width W and thickness T into a spiral or helical shape; or cutting and subsequently bending a length of metal around a form to provide the proper diameter D and length L and inducing a magnetic pole in the metal. As such processes are well known in the art no further discussion is provided.

The spiral 21 as shown in FIG. 2 is the simplest form of the present invention and is a contiguous length of metal or other magnetically attractive material having a north and south pole, and an outer edge 25 which, in turn, defines the path 15 to which the entrained ferrite particles attach. The spiral 21 has an inner edge 27 as well as a first and second side 29 and 31 respectively, defining a substantially rectangular cross section. It should be noted that the cross section of the length of material forming the spiral 21 could be any shape, for instance circular as in a conventional spring and that the orientation of the magnetic poles could be along any surface, side or edge of the spiral 21 as desired for a particular application.

The outer edge 25 of the spiral 21 can be either directly exposed to the flowing material or covered or separated therefrom by a roll cover or epoxy type filler or insulator material.

Referring now to FIG. 3, a second embodiment of the present invention will now be described. A first and second spiral 21, 22 are radially and axially aligned about a common axis, the spirals 21, 22 are circumferentially offset from one another to provide a separation between the first and second spirals 21, 22. The circumferential offset produces a relative first and second spiral gap G1 and G2 between the spirals 21, 22.

A magnetic pole inducing magnet core 23, generally composed of a plurality of semi-circular helically shaped interconnecting magnet pieces for ease of assembly, is positioned in at least one of gap G1 and G2 between the first and second spirals 21, 22. The imposition of the spiral magnet core 23 between the spirals 21, 22 provides an induced magnetic pole along the entire length of each of the spirals 21, 22. For instance the magnet core 23 in gap G1 defines a north pole adjacent the first spiral 21 thereby inducing a contiguous magnetic north pole along the length of the spiral 21. The south pole on the opposing side of the magnet 23 is positioned adjacent the second spiral 22 and induces an oppositely adjacent south pole along the second spiral 22. As is to be appreciated, such an alignment concentrates the induced north/south magnetic poles in the spirals 21, 22 thus defining a pair of spiral ferrite collection paths 15 along the surface 13 of the roll.

A second magnetic core 26 may also be advantageously provided in conjunction with the magnetic core 23 to provide further support or magnetic inducement to the spirals 21, 22 in the second spiral gap G2 defined by the first and second spirals 21, 22. The second magnetic core 26 is substantially axially and helically aligned with the spirals 21, 22 in the second space therebetween and has a cooperating north south pole arrangement with the first magnetic core 23. Specifically, both magnetic cores 23, 26 have corresponding north/north and south/south pole alignments along each magnetically induced spirals 21, 22 respectively. This is because as best understood, if a thin strip of metal is fixed to a pole of a permanent magnet an attractive force is generated on a corresponding pole of an adjacent permanent magnet positioned on the opposite side of the thin strip of metal. Thus, as shown, the magnet cores 23, 26 have the same pole aligned on either side of a single spiral.

Turning now to FIG. 4, the roll 11 is constructed about a central axis Y by forming the magnetic core 23, 26 in the gaps G1 and G2 immediately adjacent each spiral 21, i.e.

between each loop of the spirals 21, 22. The size of the magnet cores 23, 26 or magnet core 23 is determined by the pitch P of the spirals 21, 22 and the desired magnetic force to be induced therein. The magnets are inserted between the first and second spirals 21, 22 and are brought into direct contact with the mutually facing first and second sides of each of the first and second spirals 21, 22.

The magnets cores 23, 26 are provided with an inner and outer face 35 and 37 respectively. The inner face 35 of the magnet can be supported on a central support spindle 39, which defines the central axis Y about which the roll rotates. The center support spindle 39 may be supported at either end by a which may include a bearing system, enabling the rotation of the roll 11 in the apparatus 1. As such bearing support. systems are known in the art no further discussion is provided herein.

The outer face 37 of the magnets 23 may be either flush with the outer edge 25 of the spiral 21, or can be positioned with a setback S with respect to the outer edge 25 of the spiral 21 such that in use the outer edge 25 of the spiral 21 contacts the material with entrained ferrous particles. A non-ferrous coating or layer of material 41 may then be applied over the magnet core 23 between the coils of the spiral 21, to fill the setback space S. The non-ferrous coating, preferably an epoxy, is applied from the outer diameter of the magnet 23 up to the level of the outer edge 25 of the spiral 21 so that the outer edge 25 of the spiral 21 defines an exposed magnetic pole 43 of the spiral 21 and creates a substantially flush outside surface 13 of roll 11 flush along its length L with non ferrous coating 41.

The magnet cores 23, 26 of the roll 11 may be made of any number of individual magnet pieces as previously described. For ease of manufacture and assembly of the roll 11, the magnet pieces are designed to be inserted and positioned between adjacent coils of the spiral 21. Such semicircular, helically shaped pieces may be further divided into quarters, thirds or halves if necessary, again for ease of assembly. The magnet sections have a radial thickness U with respect to the inner and outer faces 35, 37 of magnet core 23, about the axis Y, and also have an axial thickness dependent upon the pitch spacing P between the first and second sides 29,31 respectively of adjacent coils or loops of the spirals 21, 22.

Further to improve ease of assembly the magnets and spirals may be assembled and inserted in a cylindrical casing or cover (not shown) to facilitate holding and maintaining all the required elements in their desired alignment during use while allowing the magnetic force of the spiral 21 to be exerted through the casing or cover.

To facilitate the removal of captured ferrous particles from the surface 13 of the roll 11, one end of roll 11, designated herein as area B, is preferably constructed with reduced strength magnet sections. The exposed poles on the spiral 21 outside edge 25 in area B will thus exhibit a net reduction in magnetic strength. When brought in physical contact with a wiper 17, area B will more easily and completely release any build up of captured ferrous particles into a collection area (not shown).

The roll 11 is completed by the addition of the central spindle 39 passing through the length of roll 11. Spindle 39 provides structural rigidity and a central means of support for the assembly. Roll 11 in use can be stationary and rotatable for ferrous particle removal, or can be continuously rotated about axis of rotation Y. In an alternative embodiment of the arrangement, a bearing 47 can be installed at both ends of sleeve 21, centered about axis of rotation Y.

The magnetic strength at the poles depends on several variables. These variables include, but are not limited to: a) material of magnet 5; b) size of magnet core 23; c) width of gap created by spiral 21 pitch P; d) diameter D; and e) material of spiral 21. Also, the effectiveness of capture of ferrous particles depends on the above magnetic strength, as well as: a) time of material contact with roll 11; b) speed of rotation of roll 11; c) amount of ferrous material in contact with roll 11; and d) attributes of the material with entrained ferrous particles. Based on the above variables, it will be obvious to a person skilled in the art that the design of a roll 11 may vary for each application.

The first and second spirals 21, 22 can be magnetized by inducement from contact with magnet core 23 as discussed in the above embodiment. Alternatively, the spiral may itself be magnetic or made magnetically attractive by other methods. For instance a pole or poles of a single magnetic spiral 21 along an outwardly facing surface or at the outside edges 25 respectively would provide the magnetized path 15 of general contact/retention for ferrous particles. The material for such a spiral 21 should preferably be ferrous, however, any magnetically attractive material such as the less common, cobalt, nickel and even rarer gadolinium and dysprosium as an example may be used as the application demands.

Figure 5:
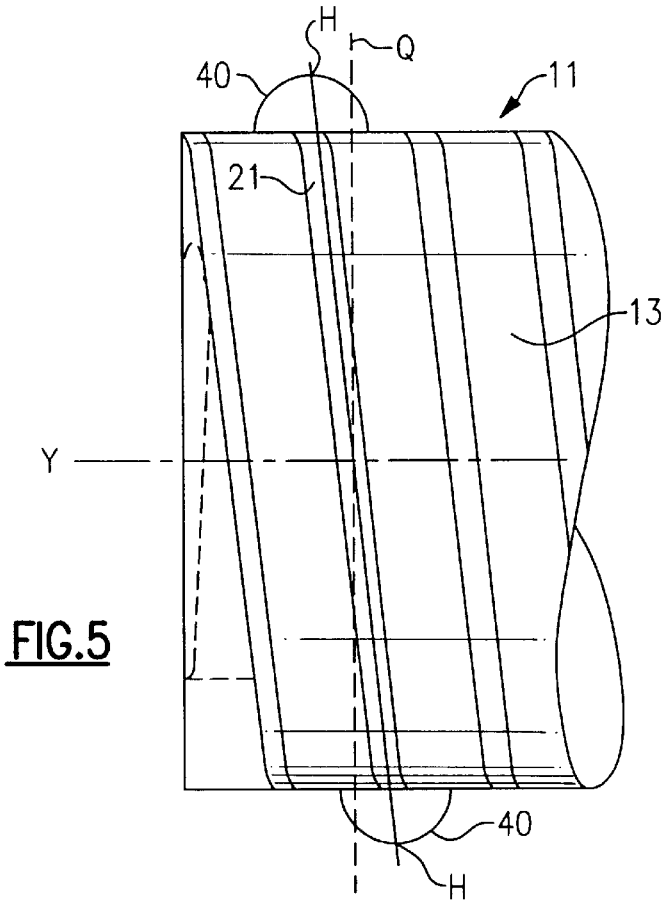
FIG. 5 is side elevation of a portion of the roll assembly showing the intersection of the ferrous particle path and magnetic field lines of the spiral magnetic pole.

Observing FIG. 5, the benefits of the above describe magnetic spiral can be best appreciated by envisioning the roll 11 as described above in an actual material flow. The axis Y of the roll 11 is positioned in a transverse orientation with respect to the material flow. Thus a ferrous particle entrained in the material flow will pass substantially perpendicularly across or close to the surface 13 of the roll as the material flows over and past the surface 13 as shown by path Q. The ferrous particle follows in essence with respect to the roll 11 and axis Y, an axially constant circumferential route, path B, past the roll 11.

The benefit of the spiral magnetic field as best understood being that a uniform radial magnetic field 40 is formed circumferentially about the surface and along the length of the roll 11 from one end to the other and therefore, the ferrous particle passing the roll 11 in an axially constant circumferential route will encounter a varying radial magnetic field as the particle passes the roll 11. The ferrous particle will be extracted from the material flow where the particle encounters a sufficiently strong portion of the radial magnetic field to overcome the bond of the material flow. The points H indicate the highest attractive force of the uniform radial magnetic field 40 on the spiral 21, and thus line HH depicts the highest radial magnetic force varying axially along the length of the roll 11. The particle path Q encounters the highest attractive force at the intersection of path Q and line HH.

The axial variance of the highest radial magnetic force shown by line HH thus provides great opportunity for the ferrous particle to be exposed to a radial magnetic force strong enough to remove the particle from the material flow. Thus as is apparent to one of skill in the art, no matter what transverse path Q past the roll 11 a particle takes, the particle will be exposed to a magnetic field strength great enough to remove the particle from the material flow.

Figure 6:
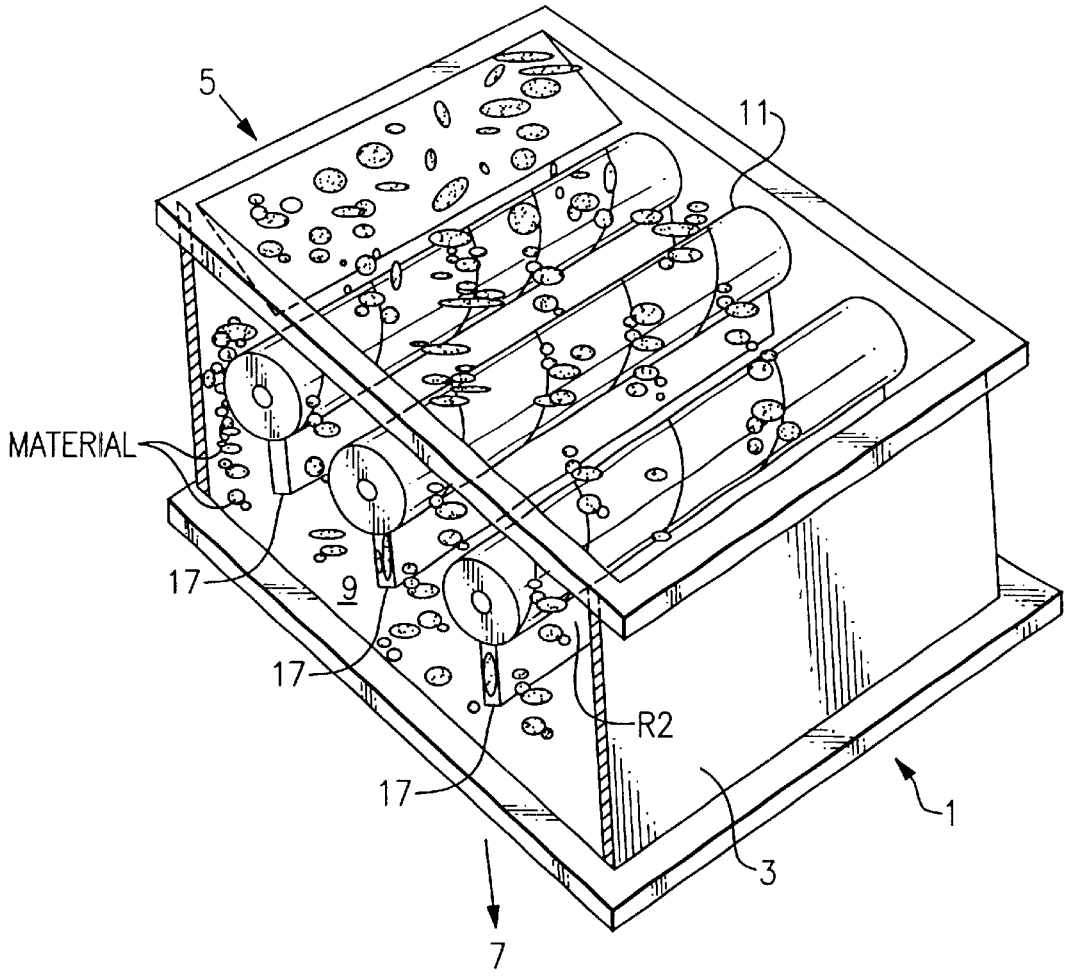
FIG. 6 is a perspective view of an alternative assembly of rolls and wipers in a housing.
Figure 7:
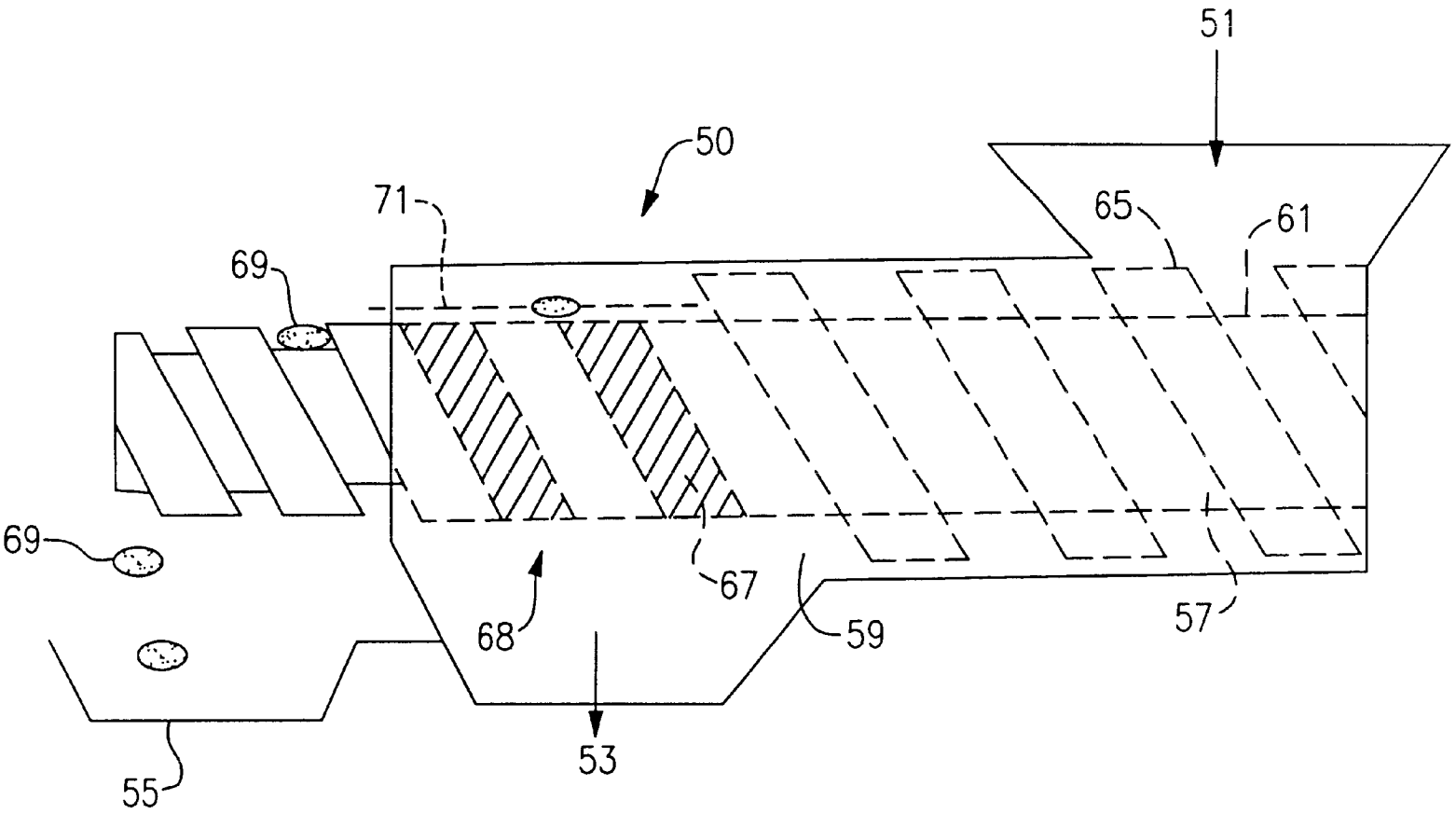
FIG. 7 is a side view of a screw conveyor embodiment apparatus utilizing the present invention.

Turning now to FIG. 6, further description of the wipers 17 will now be provided. A wiper 17 is provided for each rotating roll 11, although it is to be appreciated that it may be beneficial to associate a single wiper 17 for a plurality of roll 11's, or conversely, a plurality of wiper 17's with a single roll 11. The purpose of the wiper 17 is to clean the roll 11 of attracted ferrite particles previously removed from the material flow.

The wiper 17 is in general an elongate bar having a roll 11 contacting edge. The wiper 17 may be made from any durable non-ferrous material. The wiper 17 is aligned along a displaceable wiper axis R substantially parallel and movable with respect to the roll axis Y. The roll 11 contacting edge of the wiper 17 first position is immediately adjacent but spaced from the surface 13 of the roll 11 to allow free rotation of the roll 11 having attracted particles on the surface 13 of the roll 11.

The wiper 17 is initially set in a first position where the roll 11 contacting edge is spaced from the surface 13 as shown in FIG. 1. At a desired interval, the contacting edge of the wiper 17 is brought into a second contact position with the roll 11 surface 13 as shown in FIG. 6. This may be accomplished by any manner as is known in the art, specifically a motor may be used to transversely displace the wiper axis R, and hence the wiper 17 from the first position to the second wiping position or vice versa.

Once the wiper 17 has contacted the surface 13 of the roll 11 any attracted ferrite particles or articles on the roll surface 13 will be stopped from circumferential rotation in relation to roll 11. It is to be appreciated that without further influence, the attracted particles would tend to build up at the interface of the wiper 17 and roll 11 surface 13, however with the spiral 21 magnetic path 15 rotating in contact with the wiper 17, as will be described in greater detail below, the particles will be pushed along the magnetic path 15 towards the collection end of the roll 11, i.e. the reduced magnetic strength end B, where the particles can be removed.

The exposed poles of the spiral magnetic path 15 create the pathway along the surface 13 of the roll 11 to which the entrained particles in the material flow are attracted. With the wiper 17 initially in the first position spaced from the roll surface 13, the particles attracted to the path 15 and magnetically attached to the roll 11 will rotate in conjunction with roll 11. As a comparison, the rotating roll 11 appears as a barber pole with the attracted particles forming the continuous stripe extending from one end of the roll 11 to the other along the magnetic path 15.

When it is desired to remove the particles from the roll 11, the contacting edge of the wiper 17 is brought into contact with the roll surface 13 stopping the circumferential rotation of the particles on roll 11. The attracted particles are now effected by not only the radial magnetic pull of the exposed pole, but also the transverse longitudinal surface of wiper 17 acting along substantially the entire length of the roll 11. Under the influence of both the radial and longitudinal forces the particles are forced to follow the magnetic path 15 towards the collection end of the roll 11. This novel feature is best understood by visualization of a conventional nut and bolt where the nut is initially threaded onto the bolt and as the bolt is rotated, the nut is held in a relative fixed position with respect thereto, and after an appropriate number of rotations, dependent upon the pitch of the threads, the nut will drop off the free end of the bolt. The radial magnetic force of the path 15 can be decreased in area B as the path 15 nears the collection end of the roll 11, thus as ferrite particles build up at the area B reduced magnetic strength collection end, their own weight can overcome the attractive force of the path 15 and the particles can fall off into a collection area.

The radial magnetic force along any portion of the spiral path 15 can be reduced in any number of ways as is known in the art. In one embodiment of the present invention, the radial force attracting the particles may be reduced by tapering the outer edge 25 of the spiral path 15 at an end portion of the spiral 21 so the setback s increases between the outer edge 25 of the spiral 21 and the surface 13 of the roll 11 in area B at one end. The strength of the magnets inducing the radial magnetic force could also be reduced to diminish the radial force at an end B or along any portion of the roll 11 as well.

The wiper 17 as described above may be formed by any type of obstruction or barrier. For instance an obstruction could be imposed using a brush or an air flow or air curtain or other fluid flow which could be turned on or off at desired times. The barrier could also be positioned continuously adjacent the rotating roll and spiral to continuously push the attracted particles along the magnetic path of the spiral towards a collection area.

In another embodiment as shown in FIG. 6, the magnetic spiral may be used in conjunction with a screw type material conveyor apparatus 50. The conveyor has a material inlet 51 and a material outlet 53 as well as a ferrous particle collection bin 55. A rotating screw type conveyor 57 is situated within the through passage 59 of the material conveyor apparatus 50. The screw conveyor 57 includes a material pathway 61 in the troughs 63 defined by spiral flange 65 of the screw 57. The pathway 61 draws the material having entrained magnetic particles along the through passage 59 towards the outlet 53.

The screw conveyor 57 includes a magnetic spiral 67 along at least a magnetic portion 68 of the screw conveyor 57. As the spiral flange 65 and material pathway 61 guides the material having entrained ferrous particles 69 towards the outlet 53, the magnetic portion 68 is an axial section of the screw conveyor 57 where the material flow is brought into contact with the magnetic portion 68 prior to output from the apparatus outlet 53. At the magnetic portion 68 any ferrous particles 69 are attracted by the magnetic spiral 67 and the non-ferrous material flow is extracted or caused to drop through the outlet 53. The magnetic spiral 67 attracts the desired particles 69 which are retained on the conveyor roller 57 as the substantially non-magnetic material is removed through the outlet 53.

The attracted particles 69 on the magnetic spiral on the conveyor roller 57 encounter a barrier or obstruction 71 which can be a wiper or air flow as previously described, which pushes or forces the attracted particles 69 to follow the magnetized spiral 67 axially along the conveyor roller towards an area of reduced or nonexistent magnetic attraction where the particles are easily removed or drop into a collection bin 55.

It is to be appreciated by one of ordinary skill in the art that this apparatus and in particular the spiral magnetic path 15 and associated roll 11 may be utilized for attracting ferrite particles from innumerable materials. Differing material flows may necessitate substantial differentiations in the size of the roll 11, strength of the magnetic path 15, the spacing between a plurality of roll 11's, and the quantity of roll 11's necessary to extract the ferrite particles from the material flow.

Since certain changes may be made in the above described invention without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An apparatus for removal of entrained ferrous particles from a desired material, through magnetic attraction, comprising:

at least one spiral magnetized by inducement;

said spiral having a continuous predetermined pitch gap;

each said spiral being incorporated into a roll assembly comprising:

at least one magnet positioned in the continuous pitch gap;

at least one non-ferrous material bonded to an outside surface of the at least one magnet within the pitch gap; and a continuous exposed outer surface of the spiral;

wherein the material containing entrained ferrous particles is passed in close proximity to each said roll assembly, the ferrous particles being magnetically captured by the exposed spiral surface for subsequent removal therefrom.

2. The apparatus of claim 1 further comprising:

at least one scraper for each said roll assembly to remove said particles.

3. The apparatus of claim 2 further comprising:

a rotation means to rotate each roll assembly; and a means to automatically engage each scraper with its roll assembly to remove captured ferrous particles, each roll assembly rotated against said scraper with the rotation means.

4. The apparatus of claim 3 further comprising:

a housing containing at least one roll assembly;

each roll assembly having a central axis; and said housing having means rotatably supporting each said roll assembly about the central axis of each said roll assembly.

5. The apparatus of claim 4 further comprising:

a gravity fed agitation means, said means facilitating increased exposure of said material to each said spiral.

6. The apparatus of claim 4 further comprising:

each said roll assembly arranged to provide a close alignment between each other said roll assembly.

7. The apparatus of claim 4 further comprising:

each said roll assembly having a direction of rotation about each said central axis, said direction of rotation variable for each roll assembly; and each said roll assembly having a diameter, said diameter variable to suit a type and a volume of said desired material.

8. The apparatus of claim 4 further comprising:

each said spiral having a varying magnetic field; and said varying magnetic field having a weaker strength on a preselected discharge end of each said spiral to facilitate ease of removal of said captured magnetic particles by said scraper from the preselected end.

9. The apparatus of claim 1 further comprising:

said spiral selected from a ferrous material having high permeance.

10. A method for removal of entrained ferrous particles from a desired material, through magnetic attraction, comprising the steps of:

creating a magnetic field along a non-linear portion of an outer surface of a cylindrical roller;

positioning the cylindrical roller in a material flow;

attracting ferrous particles from the material flow onto the non-linear magnetized portion of the outer surface of the roller;

rotating the cylindrical roller relative to a linear obstruction substantially in contact with the outer surface of the roller to force the ferrous particles along the non-linear magnetic field of the outer surface of the cylindrical roller towards an area of reduced magnetic field; and removing the attracted ferrous particles from the outer surface of the roller.

11. An apparatus for removal of entrained ferrous particles from a material flow, the apparatus comprising:

an inlet and an outlet defining a material flow way therebetween;

a magnetic roller rotatably positioned in the material flow way, the magnetic roller having an outer surface defining an axial length and a radially attractive magnetic field induced between a first and a second spaced apart contiguous cylindraceous spirals extending substantially along the axial length of the outer surface of the roller; and a permanent magnet sandwiched between the first and second contiguous cylindraceous spirals to induce opposing magnetic poles of the magnetic field in the first and second spirals extending substantially along the axial length of the roller.

12. The apparatus for removal of entrained ferrous particles from a material flow as set forth in claim 11 wherein the first and second contiguous cylindraceous spirals are parallel spaced apart along the roller and define a constant pitch about the outer surface of the roller.

13. The apparatus for removal of entrained ferrous particles from a material flow as set forth in claim 12 wherein the strength of the radially attractive magnetic field of the induced cylindraceous spirals decreases adjacent one of the first and second ends of the roller to create an area of reduced radial magnetic force.

14. The apparatus for removal of entrained ferrous particles from a material flow as set forth in claim 11 the apparatus further comprising:

an obstruction extending linearly from about the first end to the second end of the roller, wherein in a contacting position the obstruction contacts the outer surface of the roller transversely intersecting the radially attractive magnetic field of the first and second cylindraceous spirals as the roller is rotated relative to the obstruction, the obstruction preventing rotation of captured ferrous particles with the outer surface of the roller and forcing the captured particles to follow the radially attractive magnetic field of the induced cylindraceous spirals along the rotating outer surface of the roller to the area of reduced radial magnetic force.

15. The apparatus for removal of entrained ferrous particles from a material flow as set forth in claim 11 wherein each said first and second contiguous cylindraceous spirals having an induced magnetic pole is provided with an outermost face directly exposed to the material flow to facilitate a full strength of the induced magnetic field effecting the material flow.

16. The apparatus for removal of entrained ferrous particles from a material flow as set forth in claim 15 wherein the outer surface of the roller is a substantially smooth cylindrical surface defined about the axial length of the roller.

17. A magnetic separator for separating entrained ferrite particles from a material flow passed through the separator, the magnetic separator comprising:

a housing defining a material flow path through which the material flow is directed;

at least one cylindrical, roller positioned within and axially aligned perpendicular relative to the material flow path and rotatably driven by a motor; the at least one cylindrical roller having an outer surface in direct contact with the material flow;

the outer surface of the cylindrical roller being defined by a separated first and second contiguous cylindraceous spirals being separated by and having opposing magnetic poles induced therein by a magnet; and wherein at least a portion of both the first and second contiguous cylindraceous spirals defining the surface of the roller being continuously directly in contact with the material flow and opposing magnetic poles induced therein generating a constant strength cylindraceous spiral magnetic field directly on the outer surface of the roller in contact with the material flow and wherein the first and second spirals each define a relative substantially separate first and second path for the attraction and retention of ferrite particles from the material flow.

* * * * *